US005675910A

United States Patent [19]

Norris et al.

[11] Patent Number: 5,675,910

[45] Date of Patent: Oct. 14, 1997

[54] RECIRCULATING BATCH PEANUT DRYING APPARATUS

[75] Inventors: Lee E. Norris; Daniel L. Norris; Aaron L. Norris, all of Mentone, Ind.

[73] Assignee: Lee E. Norris Construction & Grain Co., Inc., Menton, Ind.

[21] Appl. No.: 701,049

[22] Filed: Aug. 21, 1996

[51] Int. Cl.[6] ..... F26B 7/00

[52] U.S. Cl. ..... 34/378; 34/394; 34/443; 34/497; 34/498

[58] Field of Search ..... 34/378, 394, 423, 34/443, 426, 428, 474, 475, 476, 497, 498, 507

[56] References Cited

U.S. PATENT DOCUMENTS

| | | | |
|---|---|---|---|
| 130,695 | 8/1872 | Bowdon | 34/497 X |
| 1,053,162 | 2/1913 | Denney | 34/428 |
| 4,222,317 | 9/1980 | Curtis et al. | 454/179 |
| 4,238,890 | 12/1980 | Curtis et al. | 34/443 |
| 4,270,280 | 6/1981 | McClaren | 34/474 X |
| 4,479,309 | 10/1984 | Tolson | 34/394 |
| 4,604,815 | 8/1986 | Ridgway | 34/201 |
| 5,230,160 | 7/1993 | Gross et al. | 34/263 |
| 5,551,167 | 9/1996 | Van Fossen | 34/497 X |
| 5,551,168 | 9/1996 | Van Fossen | 34/497 X |

*Primary Examiner*—John M. Sollecito
*Assistant Examiner*—Steve Gravini
*Attorney, Agent, or Firm*—James D. Hall

[57] ABSTRACT

A recirculating batch peanut drying apparatus including a drying station for heating the peanuts, a tempering station for cooling the peanuts after heating, and a recirculating device which transports the peanuts in a continuous flow between the drying station and the tempering station.

2 Claims, 5 Drawing Sheets

RECIRCULATING BATCH PEANUT DRYING APPARATUS

The present invention relates to an apparatus for curing peanuts.

BACKGROUND OF THE INVENTION

Conventional peanut drying systems typically employ large, flat bed trailers which hold batches of peanuts several feet deep. Heated air is distributed under the perforated floor of each trailer and forced up through the batch of peanuts to remove moisture from the peanuts.

These conventional drying systems are undesirably slow because of the low temperatures at which they operate. It is known that peanut quality degrades if, during drying, the peanuts are exposed to temperature changes, maximum temperatures, or moisture removal rates in excess of certain empirically determined limits. Thus, the drying speed associated with conventional drying systems can not be increased, without sacrificing quality, simply by increasing the temperature of the heated air. The temperature of the applied heat is also limited by the depth of the batch of peanuts because the heat required to effectively dry the surface peanuts can result in damage, such as kernel skin splits, to the lower level peanuts. Such damage can occur even at relatively low temperatures when exposure is sustained for many hours. Consequently, peanut processors must contend with long drying times and expensive delays in product shipment, particularly in years when harvested peanuts have higher than normal moisture content.

Furthermore, nearly ideal growing conditions for Aflatoxin-producing *Aspergillus flayus* (*A. flayus*) mold spores are provided by the biological heating of peanuts that occurs on poorly ventilated trucks or temporary storage containers as the wet peanuts await drying. Also, since the deep peanut batches are not mixed during the extended drying periods, the upper layers of peanuts are exposed for many hours to the warm, damp air rising through the batch of peanuts. These peanuts do not even begin to dry until after the lower level peanuts are substantially dry. Again, this saturated, warm air promotes mold development. Even if, after an initial drying period, the batch is mixed, the additional drying time required after such a mixing operation provides further opportunity for mold spore reproduction. Peanuts with damaged kernels are particularly vulnerable as they provide ideal locations for rapid infection by Aflatoxin.

The following described invention is provided to accommodate the need for a better system for drying peanuts.

SUMMARY OF THE INVENTION

The present invention provides an apparatus for drying peanuts that substantially reduces the required drying time and the susceptibility of the peanuts to Aflatoxin infection, without sacrificing the quality of the peanuts. The present invention employs continuous flow drying and includes a drying station, a tempering station, and a recirculating device which transports peanuts between the drying station and the tempering station. More particularly, the drying station includes a conveyor which moves a layer of peanuts through the drying station enclosure while a blower forces heated air through the layer of peanuts. The tempering station includes a conveyer which receives the heated peanuts from the drying station and transports them through the tempering station enclosure. A fan draws cooler air through the layer of peanuts lying on the tempering conveyor. The cooled peanuts are discharged from the tempering station into the recirculating device which carries the peanuts back to the drying station for an additional drying cycle followed by tempering. When the peanuts have completed a predetermined number of drying and tempering cycles, the recirculating device receives the dry peanuts from the tempering station and deposits them into a storage container or transport vehicle for further processing.

The apparatus of the present invention permits use of higher heating temperatures than was possible with conventional systems because it provides short periods of heating followed by longer periods of tempering and mixes or blends the peanuts during the drying/tempering cycles. The repeated mixing that occurs as the peanuts tumble from one station to the next ensures uniform curing, deters mold growth, and prevents heat damage, even though higher heating temperatures are employed. The alternating heating and tempering periods permit the kernels to stabilize between heat applications, greatly reducing the risk of kernel splits. Higher heating temperatures drastically reduce peanut drying time. Faster drying time permits higher volume processing and reduces storage time for freshly harvested, wet peanuts awaiting drying. The more quickly freshly harvested peanuts are dried, the less likely it is that infection by Aflatoxin will result.

Accordingly, an object of the invention is to provide a peanut drying apparatus that decreases peanut drying time.

Another object of the invention is to provide a peanut drying apparatus that uniformly cures peanuts in a batch.

Another object of the invention is to provide a peanut drying apparatus that reduces peanut damage resulting from both applied heat and biological heating.

Still another object of the present invention is to provide a peanut drying apparatus that reduces the risk of Aflatoxin infection.

BRIEF DESCRIPTION OF THE DRAWINGS

The above-mentioned and other objects and advantages of this invention, and the manner of attaining them, will become more apparent and the invention will be better understood by reference to the following description of an embodiment of the invention taken in conjunction with the accompanying drawings, wherein.

Figure 1:
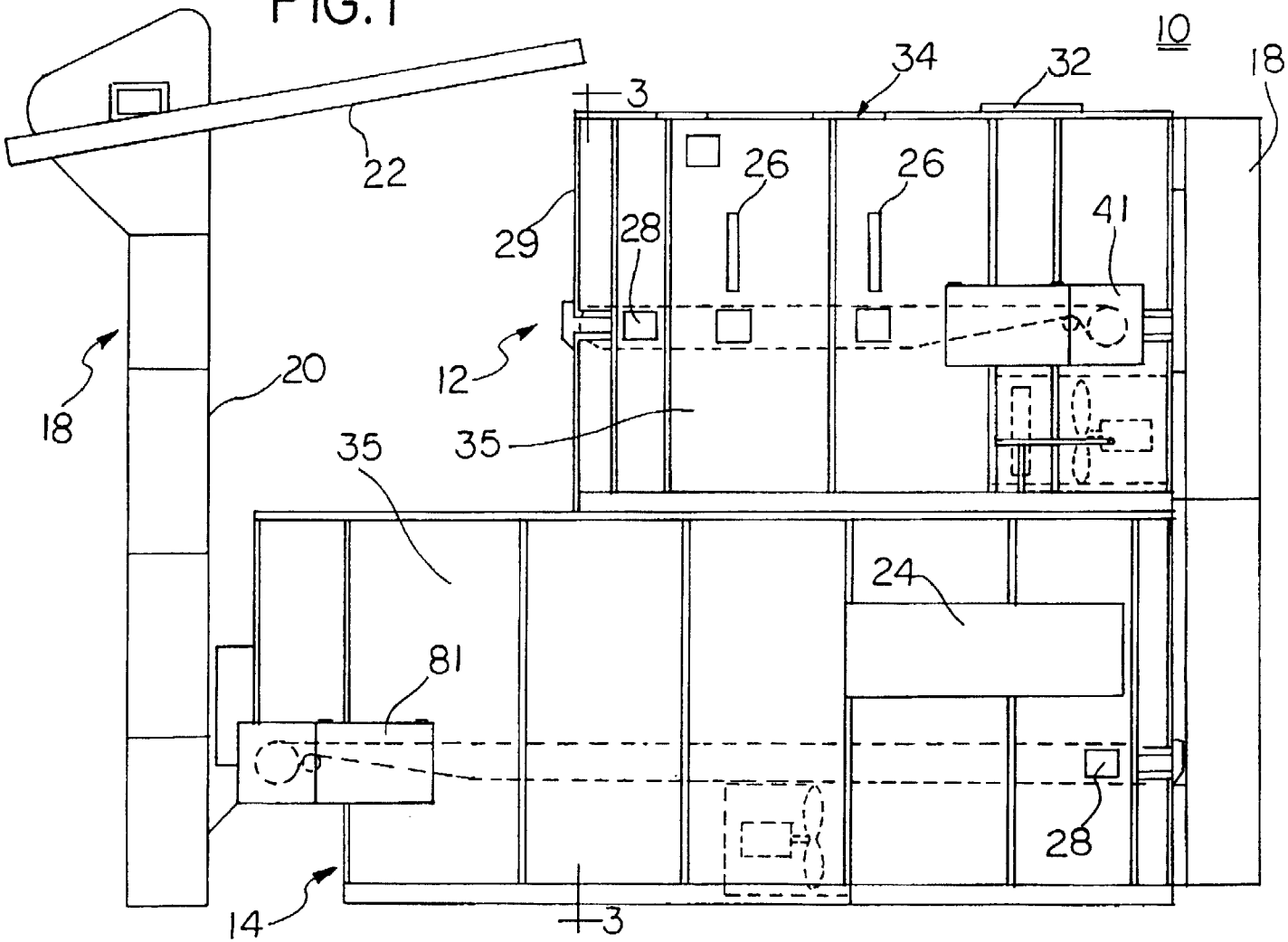
FIG. 1 is an elevational view of the peanut drying apparatus of the present invention with certain interior components shown in broken lines.
Figure 2:
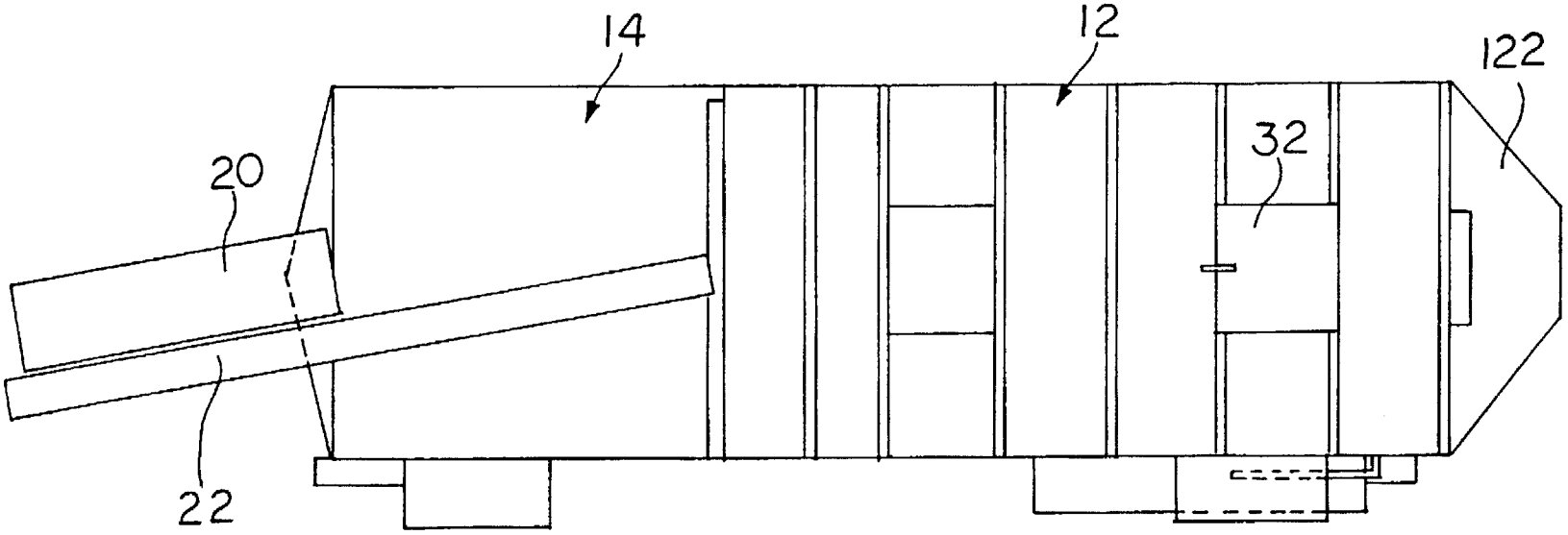
FIG. 2 is a top plan view of the peanut drying apparatus of the present invention.
Figure 3:
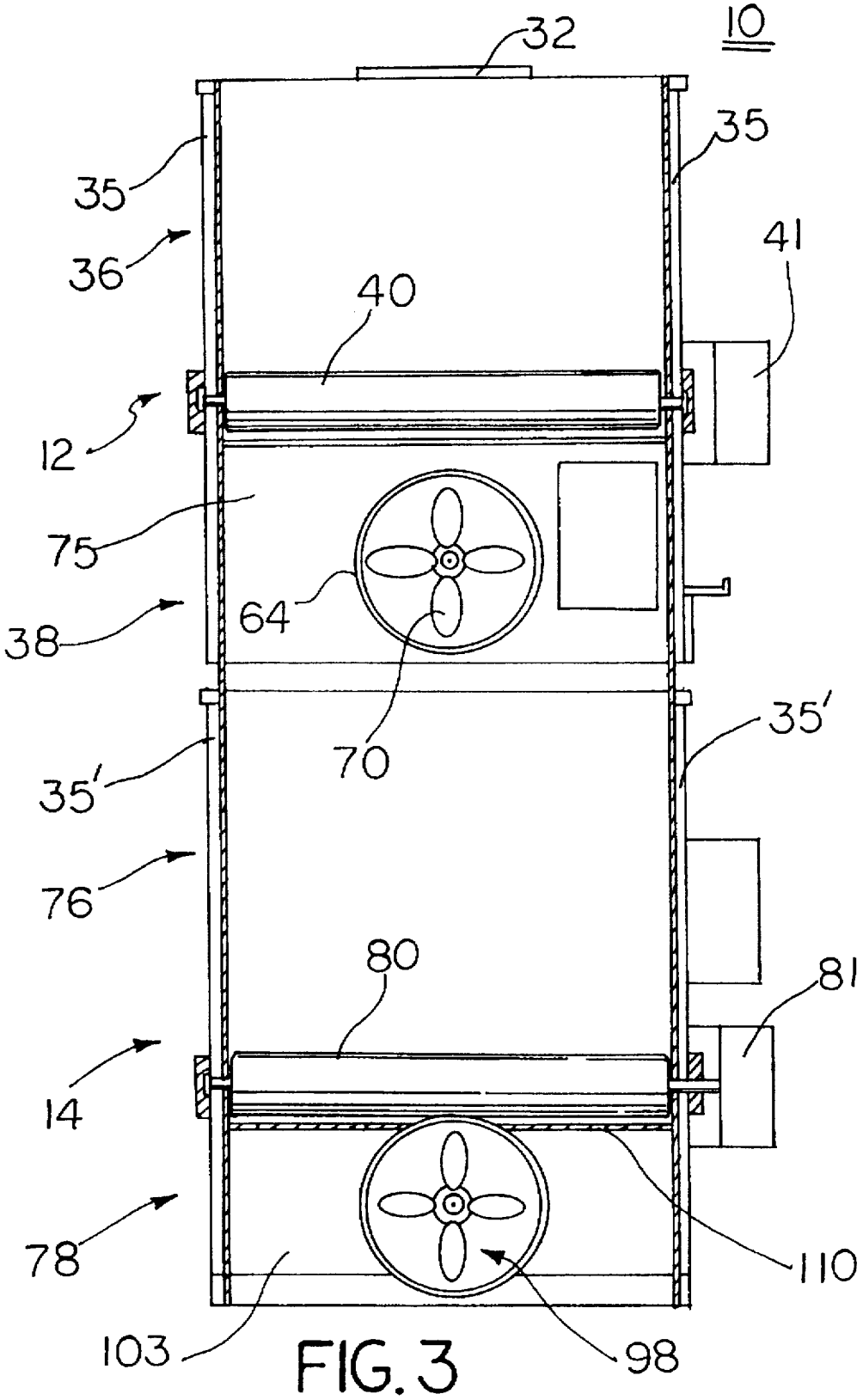
FIG. 3 is a cross-sectional view taken substantially along line 3—3 of FIG. 1.

Corresponding reference characters indicate corresponding parts throughout the several views. Although the drawings represent an embodiment of the present invention, the drawings are not necessarily to scale and certain features may be exaggerated in order to better illustrate and explain the present invention.

DESCRIPTION OF THE INVENTION

The embodiments disclosed in the detailed description below are not intended to be exhaustive or to limit the invention to the precise forms disclosed. Rather, the embodiments selected for the description are disclosed so that others skilled in the art may utilize their teachings.

FIG. 1 shows the recirculating batch peanut drying apparatus of the present invention, generally designated 10. Drying apparatus 10 shown has two processing stations: a drying station 12 and a tempering station 14. Peanuts 16 are moved from tempering station 14 to drying station 12 by a recirculating device 18 which includes a product elevator 20 and return belt 22 as described in further detail below. Each station 12,14 resembles a substantially enclosed rectangular housing and, in an exemplary embodiment of the invention, drying station 12 is stacked on top of tempering station 14. Various control boxes 24 are mounted to the outer walls of stations 12,14 to provide control over the conveyors, blowers and various other components contained therein. Control boxes 24 and associated circuitry are well known in the art and do not form a part of this invention. Inspection windows 26 and doors 28 are also disposed on the outer walls of stations 12,14 to facilitate operation monitoring. An access hatch 32 is located in the top wall 34 of drying station 12.

Figure 4:
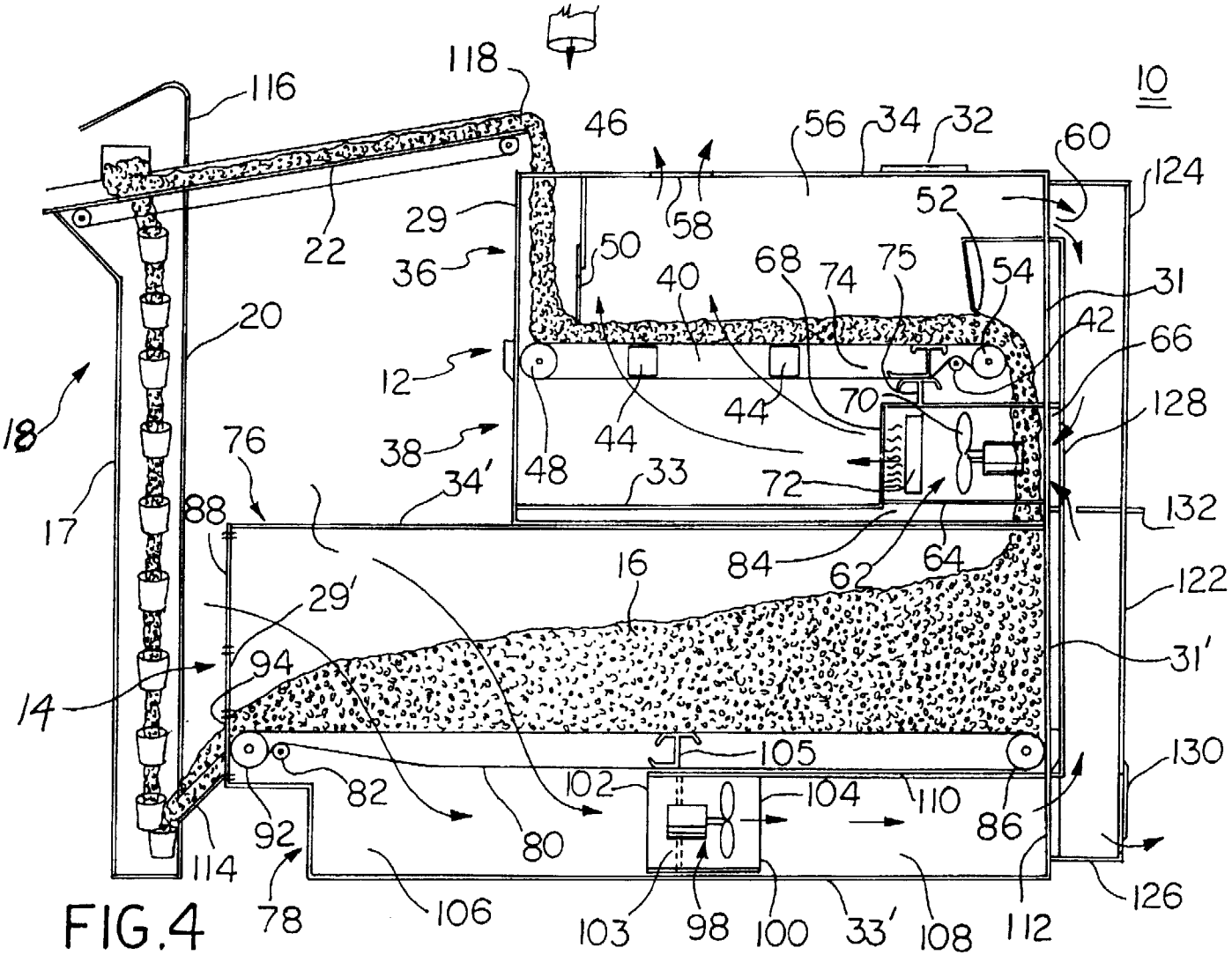
FIG. 4 is a partially fragmented elevational view similar to FIG. 1 depicting the movement of peanuts and airflow through the apparatus of the present invention.

Referring now to FIG. 4, drying station 12, bounded by front wall 29, rear wall 31, bottom wall 33, top wall 34, and side walls 35, includes an upper portion 36 and a lower portion 38 separated by a dryer conveyor 40 formed of a metal link-chain belt or other suitable material that permits relatively unrestricted airflow therethrough. Idler pulley 42 monitors tension on conveyor 40. Conveyor 40 is driven by a motor 41. In an exemplary embodiment of the peanut drying apparatus 10 of the present invention, air stirring fans 44 are disposed below dryer conveyor 40. Top wall 34 of upper portion 36 has a product intake opening 46 which is disposed above the load end 48 of dryer conveyor 40. A leveling gate 50 is adjustably suspended above load end 48 of dryer conveyor 40 and an air seal partition 52 is suspended above the discharge end 54 of dryer conveyor 40. A heating section 56 of portion 36, bounded by top wall 34, dryer conveyor 40, leveling gate 50 and air seal flap 52, accommodates an exhaust opening 58 and a hot air return port 60.

Lower portion 38 of drying station 12 extends the length of the drying station between side walls 35. Lower portion 38 includes a heater assembly 62 contained within a substantially cylindrical, open-ended blower enclosure 64 having an intake end 66 and an exhaust end 68. A fan 70 having a blade diameter substantially conforming to the inner diameter of blower enclosure 64 is mounted proximate intake end 66 of enclosure 64. A heating element 72 is mounted proximate exhaust end 68. An air lock 74 mounted between discharge end 54 of dryer conveyor 40 and blower enclosure 64 and partition 75 surrounding blower enclosure 64 substantially contain air within lower portion 38.

Tempering station 14, bounded by front wall 29', rear wall 31', bottom wall 33', top wall 34', and side walls 35', similarly includes an upper portion 76 and a lower portion 78 separated by a tempering conveyor 80 formed of a metal link-chain belt or other suitable air-permeable material and driven by a motor 81. A tempering conveyor idler pulley 82 is also provided. Upper portion 76 includes a collection opening 84 which is substantially aligned vertically between the load end 86 of tempering conveyer 80 and discharge end 54 of dryer conveyor 40. A fresh air intake 88 extends through the front wall 29' of tempering station 14 adjacent and above the discharge end 92 of tempering conveyor 80, and an outlet opening 94 is formed in front wall 29' directly adjacent and in alignment with discharge end 92 of tempering conveyor 80.

Lower portion 78 of tempering station 14 extends the length of the tempering station and is bounded by front wall 29', rear wall 31', bottom wall 33', side walls 35', and tempering conveyor 80. Lower portion 78 includes a fan 98 mounted within a fan enclosure 100 having an intake end 102 and an exhaust end 104. The diameter of fan 98 blades substantially conforms to the inner diameter of fan enclosure 100. Fan enclosure 100 extends through partition 103 which, along with air lock 105, divides lower portion 78 into an air intake section 106 bounded at the top by tempering conveyor 80, and an air exhaust section 108 bounded at the top by a solid wall 110 spaced below tempering conveyor 80. Exhaust section 108 has an opening 112 formed in rear wall 31'.

A transfer chute 114 extends from outlet opening 94 to a commonly available product bucket lift or vertical elevator 20. The top 116 of elevator 20 discharges peanuts 16 onto a reversible return belt 22 or conveyor. One end 118 of reversible belt 22 terminates above product intake opening 46 of drying station 12. The other end 120 terminates adjacent a dry peanut discharge chute (not shown).

A duct or plenum 122 extends vertically between drying station 12 and tempering station 14 as shown in FIGS. 1 and 4. The upper end 124 of plenum 122 is in air flow communication with hot air return port 60 of drying station 12 and the lower end 126 is in air flow communication with opening 112 of tempering station 14. A center opening 128 of plenum 122 is in flow communication with intake end 66 of blower enclosure 64. Air flow through plenum 122 is partially controlled by adjusting the size of a vent 130 disposed at lower end 126 of plenum 122 and a flow restricter 132 disposed adjacent intake end 66 of blower enclosure 64.

Mode of Operation

Peanuts 16 are loaded into the recirculating peanut drying apparatus 10 of the present invention through product intake opening 46 using a standard product delivery mechanism such as via a truck conveyor. The peanuts 16 are distributed evenly across the width of dryer conveyor 40 to accomplish more efficient peanut drying. The speed of dryer conveyor 40 and the peanut fill rate are adjusted such that a selected layer of peanuts 16 accumulates on dryer conveyor 40 below intake opening 46. As dryer conveyor 40 transports peanuts 16 into heating portion 56 of drying station 12, the selected depth oft he layer of peanuts 16 is determined by the distance between leveling gate 50 and the upper surface of dryer conveyor 40. Peanuts 16 carried through heating portion 56 are heated from below as air is forced from exhaust end 68 of blower enclosure 64 into lower portion 38 of drying station 12. Air stirring fans 44 assist the passage of heated air through peanuts 16 and mix the peanuts to avoid overheating of lower level peanuts 16. The heated air removes moisture from peanuts 16 and carries a substantial portion of that moisture out exhaust opening 58 at top 34 of drying station 12. Another portion of the heated air is recycled back to intake end 66 of blower enclosure 64 through hot air return port 60, into plenum 122, and out plenum center opening 128. Since this portion of air is already at an elevated temperature, heater assembly 62 runs more efficiently.

After heating, the layer of heated peanuts 16 moves under air seal flap 52 which, along with air lock 74 and partition 75, substantially prevents heated air from escaping into tempering station 14 where the peanuts 16 are being cooled. Peanuts 16 then fall from discharge end 54 of dryer conveyor 40, some cascading onto and deflecting around blower enclosure 64, through collection opening 84 in tempering station 14, and onto the load end 86 of tempering conveyor 80. This manner of peanut transfer from drying station 12 to tempering station 14 automatically provides beneficial random mixing of the heated peanuts 16.

The speed of tempering conveyor 80 is adjusted to produce the desired depth of peanuts 16. As peanuts 16 move from load end 86 of tempering conveyor 80, where no air is forced through the peanuts, to discharge end 92, the peanuts cool and stabilize internally. As peanuts 16 are transported over intake section 106 of lower portion 78, cooler air dram through fresh air intake 88 moves through the layer of peanuts 16 and tempering conveyor 80 into intake end 102 of fan 98 as suggested by the arrows in FIG. 4. This air absorbs some of the heat imparted to peanuts 16 by drying station 12. The speed of fan 98 is adjustable and depends partly upon the amount of moisture remaining in the peanuts 16. The air forced through opening 112 in exhaust section 108 is advantageously pre-heated when supplied through plenum center opening 128 to intake end 66 of blower enclosure 64. The volume of air provided to plenum center opening 128 is adjusted by raising or lowering vent 130, permitting a portion of the air to escape to the atmosphere, and by sliding flow restricter 132 inwardly to decrease the opening through which the pre-heated air may pass to center opening 128.

When peanuts 16 reach discharge end 92 of tempering conveyor 80, the peanuts fail into transfer chute 114 which delivers them to recirculating device 18. Again, as peanuts 16 tumble into and down transfer chute 114, the peanuts are advantageously mixed in a random fashion to ensure uniform curing throughout the batch. Product elevator 20 of recirculating device 18 of the present invention receives peanuts 16 into buckets 17 or other suitable vertical transport containers. Peanuts 16 are carded to top 116 of product elevator 20 where the peanuts are dumped from the buckets or storage containers onto return belt 22. The process of delivering peanuts 16 to return belt 22 provides an additional mixing function to enhance peanut curing. Return belt 22 is bi-directional. Normally, when the batch of peanuts 16 is not yet dry, return belt 22 is set to transport peanuts 16 toward end 118 into product intake opening 46 to begin another cycle of heating and tempering as described above. When it is determined that peanuts 16 are sufficiently dry, return belt 22 is reversed, and peanuts 16 fall from other end 120 of belt 22 into a discharge chute (not shown) or other delivery system which deposits the dried peanuts 16 into a storage container or vehicle for subsequent processing and packaging.

Figure 5:
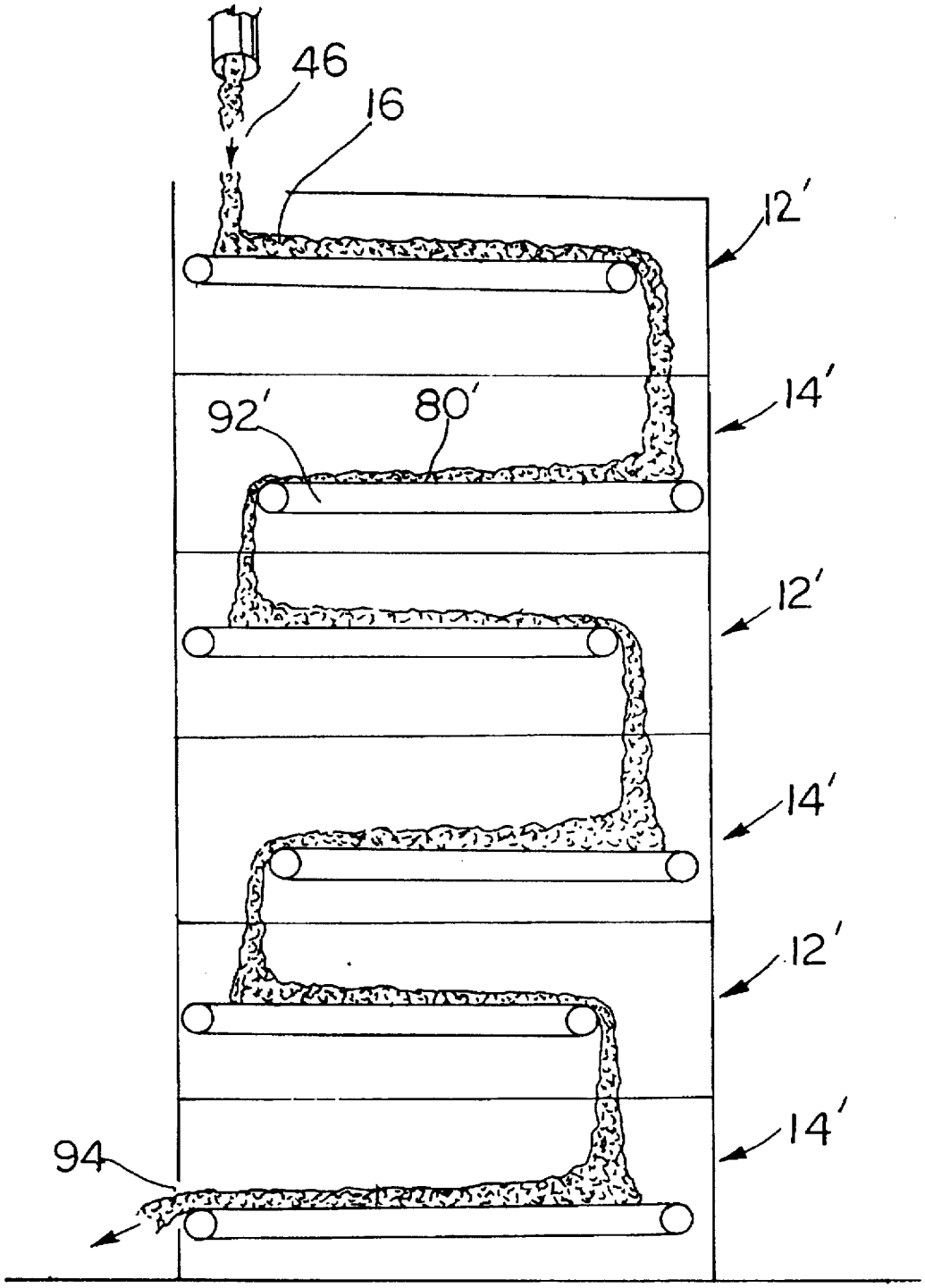
FIG. 5 is a conceptual elevational view of another embodiment of the peanut drying apparatus of the present invention.

In another embodiment of the present invention, drying stations 12' and tempering stations 14' are stacked to form a series of alternating stations, drying stations 12' followed by tempering stations 14', as illustrated in FIG. 5. Peanuts 16 are loaded through intake opening 46, then heated and tempered substantially as described above except that when the peanuts reach the discharge end 92' of tempering conveyor 80', the peanuts fall through the intake opening 46' of another drying station 12' for an additional drying cycle. No recirculating device 18 is used. Instead, a sufficient number of drying stations 12' and tempering stations 14' are stacked in alternating sequence to accomplish the desired number of heating and tempering cycles. Ultimately, fully dried peanuts 16 are discharged through outlet opening 94 for subsequent processing and packaging.

While this invention has been described as having exemplary embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for drying peanuts comprising the steps of:

heating the peanuts in a drying enclosure;

discharging the heated peanuts from said drying enclosure to a tempering enclosure;

drawing cooler air through said tempering enclosure to cool the peanuts; and recycling the peanuts from said tempering enclosure to said drying enclosure for an additional heating step followed by said cooling step in said tempering enclosure.

2. A method for drying peanuts comprising the steps of:

heating the peanuts in a first drying enclosure;

discharging the heated peanuts from said first drying enclosure to a first tempering enclosure;

drawing cooler air through said first tempering enclosure to cool the peanuts;

discharging the cooled peanuts from said first tempering enclosure to a second drying enclosure;

re-heating the peanuts in said second drying enclosure;

discharging the re-heated peanuts from said second drying enclosure to a second tempering enclosure; and drawing cooler air through said second tempering enclosure to cool the peanuts.

* * * * *